US007104900B1

(12) United States Patent
Finley

(10) Patent No.: US 7,104,900 B1
(45) Date of Patent: Sep. 12, 2006

(54) DIAGNOSTIC DEVICE FOR ANALYZING A GOLF SWING

(76) Inventor: Marc Finley, 300 N. Isundega St., Westminister, SC (US) 29693

( * ) Notice: Subject to any disclaimer, the term of this patent is extended or adjusted under 35 U.S.C. 154(b) by 355 days.

(21) Appl. No.: 10/641,764

(22) Filed: Aug. 15, 2003

(51) Int. Cl.

| | |
|---|---|
| ***A63B 57/00*** | (2006.01) |
| ***A63B 69/36*** | (2006.01) |
| ***A63B 53/06*** | (2006.01) |
| ***A63B 53/16*** | (2006.01) |
| ***A63B 67/14*** | (2006.01) |

(52) U.S. Cl. ..... 473/278; 473/280; 473/131; 473/145; 473/190; 473/257; 473/409; 273/108; 273/108.2

(58) Field of Classification Search ..... 473/278–280, 473/219–226, 405, 406, 293, 150–155, 138–140, 473/131, 145, 190–199, 257, 409; 273/108, 273/108.2

See application file for complete search history.

(56) References Cited

U.S. PATENT DOCUMENTS

| | | | | |
|---|---|---|---|---|
| 3,870,314 | A * | 3/1975 | Bertucci | 473/141 |
| 4,130,283 | A * | 12/1978 | Lindquist | 473/262 |
| 4,451,043 | A * | 5/1984 | Ogawa et al. | 473/225 |
| 4,971,325 | A * | 11/1990 | Lipps | 473/209 |
| 5,156,398 | A * | 10/1992 | Kibamoto | 473/278 |
| 5,593,355 | A * | 1/1997 | Beaver | 473/278 |
| 5,885,168 | A * | 3/1999 | Bair | 473/278 |
| 6,106,409 | A * | 8/2000 | Jackson, Jr. | 473/278 |
| 6,616,556 | B1 * | 9/2003 | Osmudsen | 473/452 |
| 6,793,585 | B1 * | 9/2004 | Miyamoto et al. | 473/151 |
| 6,821,210 | B1 * | 11/2004 | Kallage, Jr. | 473/218 |
| 2004/0127304 | A1 * | 7/2004 | Plank | 473/221 |
| 2004/0137999 | A1 * | 7/2004 | Park | 473/278 |
| 2005/0130755 | A1 * | 6/2005 | Lindsay | 473/151 |
| 2005/0202893 | A1 * | 9/2005 | Otten et al. | 473/219 |

* cited by examiner

*Primary Examiner*—Xuan M. Thai
*Assistant Examiner*—Binh-An D. Nguyen

(57) ABSTRACT

A golf mat similar to the type used at a driving range, including a hole for inserting a golf tee, with the addition of a pressure sensor (transducer) embedded in one corner of the mat, sandwiched between a top artificial grass and a bottom rubber backing of the mat, for use in activating an alarm when the golf club head strikes the area just behind the ball, above the pressure sensor, before striking the ball. When the golf club strikes the area above the sensor, an electrical signal is sent to the input of a timer circuit, which then provides a signal of a few seconds in time to the input of a visible alarm. Lines are included on the top surface of the mat to mark off the boundaries directly above the pressure sensor so a golfer will not step in this area and set off a false alarm. In use, when the golfer makes a good swing with the club head striking the ball solidly, without hitting the ground first, then the alarm will not flash a light. On the other hand, if the club head strikes the ground prior to contacting the ball, then the alarm will flash a light for ten seconds notifying the golfer that attention needs to be given to this area of the swing.

20 Claims, 2 Drawing Sheets

DIAGNOSTIC DEVICE FOR ANALYZING A GOLF SWING

BACKGROUND OF THE INVENTION

1. Field of the Invention

The present invention relates to a golf diagnostic device for use in connection with analyzing a golf swing. The diagnostic golf device has particular utility as a training aid to assist a golfer in improving his/her swing during practice sessions at a driving range.

2. Description of the Prior Art

Most golfers spend a lot of time at driving ranges working on their swing in an attempt to improve their game. Diagnostic tools for analyzing the golf swing are desirable to help the golfer know what's wrong with his/her swing and when a good swing is made. Particularly when the balls are being hit into a net, so that the golfer can't visually see the results of the swing, it is important to have some form of diagnostics to inform the golfer of his/her progress or lack thereof in improving his/her game.

The use of golf diagnostic tools is known in the prior art. For example, U.S. Pat. No. 4,304,406 to Cromarty discloses a golf training and practice apparatus, which uses a plurality of sensors and a television display system to measure the positions of a golf club head during the swing at a ball. However, the Cromarty '406 patent does not use a simple audible signal to inform the golfer whether or not a good swing occurs, and has the further drawback of requiring the golfer to study a television display between swings.

U.S. Pat. No. 6,039,658 to Cecchin, U.S. Pat. No. 5,916,036 to Hamilton, and U.S. Pat. No. 5,779,557 to Scannell et al. all disclose golf practice apparatus that emphasizes the balance and distribution of the golfer's weight on his/her feet during a golf swing. However, none of these patents put emphasis on determining whether or not the club head hits the mat in front of the ball, and additionally none of these provide a simple audible signal indicating when the club does hit the mat, as does the apparatus of the present invention.

Similarly, U.S. Pat. No. 5,358,251 to Ashton discloses a golf training aid/simulator, which has an adjustable base that the golfer stands on relative to the ball to make a swing. Again, this apparatus then measures how the golfers weight is distributed between the feet during the swing. However, while the distribution of body weight is critical to a good golf swing, so is the position of the club head just prior to contacting the ball and the Ashton '251 patent does not provide a simple audible signal indicating when the club hits the ground prior to hitting the ball, as does the apparatus of the present invention.

Lastly, United States Design Patent Number D395,457 to Tsou discloses the design of a golf putting and driving practice mat, which may be of general interest and pertinent to the construction and design of the present invention. Although the Tsou '457 patent does not provide any sensors for analyzing the golfers swing, it does illustrate the typical structure of golf mats.

While the above-described devices fulfill their respective, particular objectives and requirements, the aforementioned patents do not describe a golf swing diagnostic device that determines the position of the golf club head just prior to contacting the ball and provides a visible signal if the club head strikes the mat before hitting the ball.

Therefore, a need exists for a new, improved, simple and easy to use golf diagnostic device, which determines if the club head strikes the mat just prior to contacting the ball and provides a visible signal if it does, indicating that much of the dynamic energy has gone into the mat (or ground) instead of into the ball, and does not effect the golfers practice session except for a short visible light that flashes when a bad shot is made. In this regard, the present invention substantially fulfills this need. In this respect, the golf swing diagnostic device according to the present invention substantially departs from the conventional concepts and designs of the prior art, and in doing so provides an apparatus primarily developed for the purpose of helping a golfer improve his/her golf game.

SUMMARY OF THE INVENTION

In view of the foregoing disadvantages inherent in the known types of golf diagnostic apparatus now present in the prior art, the present invention provides an improved golf swing diagnostic device, and overcomes the above-mentioned disadvantages and drawbacks of the prior art. As such, the general purpose of the present invention, which will be described subsequently in greater detail, is to provide a new and improved golf diagnostic device and method, which has all the advantages of the prior art mentioned heretofore and many novel features that result in a golf swing diagnostic device that is not anticipated, rendered obvious, suggested, or even implied by the prior art, either alone or in any combination thereof.

To attain this, the present invention essentially comprises a training device that will teach a golfer to make solid contact with the ball. The device is comprised of a golf mat, similar to the type used at a driving range, with the top surface covered with artificial grass and the backing fabricated from a high-traction type rubber to help prevent the mat from slipping on the underlying surface. The mat is typically 4-feet square and 1 to 2-inches thick and can be provided in configurations for both right-handed and left-handed golfers. The mat also includes a hole for inserting a golf tee.

The uniqueness of the device as it relates to the present invention is the addition of a pressure sensor (transducer) embedded in one corner of the mat, sandwiched between the top artificial grass and the bottom rubber backing for use in setting off an alarm when the golf club head strikes the area above the pressure sensor. When pressure is applied to this sensor, such as caused by the club head striking the mat above the sensor, an electrical signal is sent to the input of a timer circuit, which then provides a signal of a few seconds in time to a visible alarm. Lines are included on the top surface of the mat to mark off the boundaries directly above the pressure sensor so a golfer will not step in this area and set off a false alarm. The hole in the mat for the tee is located just beyond the front line perpendicular to the direction of the golf swing. The golfer stands outside the side boundary line, which is parallel to the golf swing. Optionally, a golfer may remove the tee and position the ball on the grass surface just outside the front boundary line in the general area of the tee hole.

In golf it is desirable for the head of the club to hit the ball prior to hitting the ground in order to transfer the maximum amount of dynamic energy from the head to the ball. In the case of an iron, the golfer will often try to put backspin on the ball by hitting downward on the ball. In this case the club will hit the ground, but after it hits the ball. Unfortunately, many amateur golfers struggle with the problem of the club head hitting the ground just before contacting the ball, thereby transferring a portion of the available energy into the ground and reducing the length of the drive.

The device of the present invention can be used to help teach a golfer to not to allow the club head to contact the ground behind the ball before making contact with the ball. In use, the golfer places ball on the tee or on the mat just beyond the front (leading) boundary of the pressure sensor and then hits the ball in a conventional manner. If the golfer makes a good swing with a wood, and the club head passes over the mat, the club head will hit the ball solidly and the alarm will remain silent, indicating, to the golfer that he/she has hit a good shot. However, if the golfer makes a bad shot where the club head strikes the ground prior to hitting the ball, the alarm will flash a light for a few seconds, thereby indicating that attention needs to be given to this area of the swing. As the golfer hits practice balls, he can concentrate on swinging the club correctly so the alarm does not flash. This approach is more or less transparent to the normal way a golfer hits balls from the practice tee, except for an occasional visible alarm, but the device will help the golfer develop a better swing, which in the long run will result in lower scores on the golf course.

There his thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new golf swing diagnostic device that provides in the apparatuses and methods of the prior art some of the advantages thereof, while simultaneously overcoming some of the disadvantages normally associated therewith.

It is another object of the present invention to provide a new and improved diagnostic device for analyzing a golf swing, that is easy to use and does not interfere with the normal way a golfer hits practice balls, but at the same time provides valuable information relating to the quality of his/her swing.

An even further object of the present invention is to provide a new and improved golf swing diagnostic device that may be easily and efficiently manufactured and marketed.

Still another object of the present invention is to provide a new and improved golf swing diagnostic devise that has a low cost of manufacture with regard to both materials and labor, and which accordingly is then susceptible of low prices of sale to the consuming public, thereby making such equipment economically available to the buying public.

Lastly, it is an object of the present invention to provide a new and improved method for analyzing ones golf swing that allows a golfer to hit practice balls in a normal manner, but at the same time provides valuable information relating to the quality of his/her swing.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
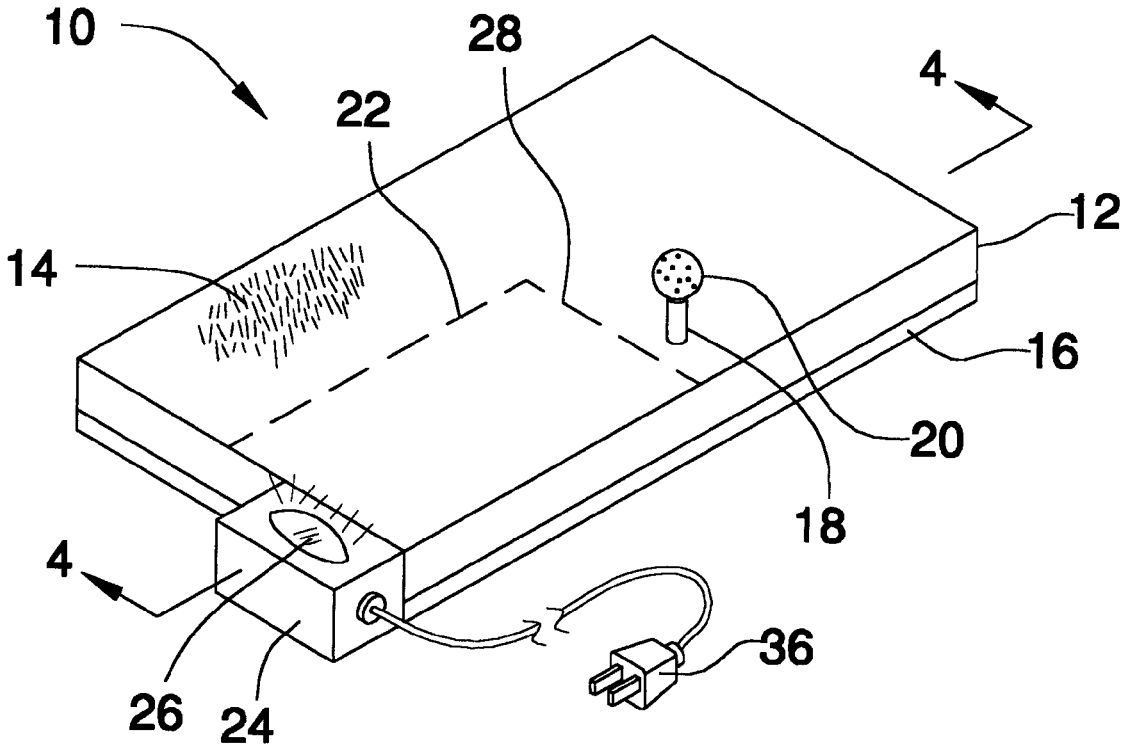
FIG. 1 is a perspective drawing of the preferred embodiment of the golf swing diagnostic device constructed in accordance with the principles of the present invention.

Referring now to the drawings, and particularly to FIGS. 1–5, a preferred embodiment of the golf swing diagnostic device of the present invention is shown and generally designated by the reference numeral 10.

Figure 2:
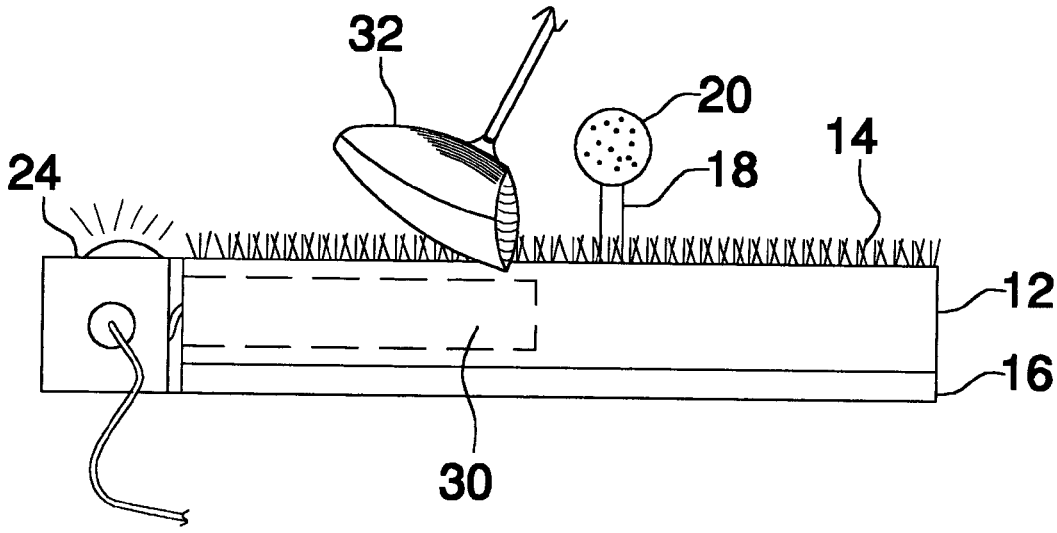
FIG. 2 is a side view of the golf swing diagnostic device of the present invention illustrating a poor golf swing where the club strikes the mat prior to contacting the ball.

In FIGS. 1 and 2 show perspective and side views, respectively, of the new and improved golf swing diagnostic device 10 of the present invention for analyzing a critical aspect of a golfer's swing is illustrated and will be described. More particularly, the golf swing diagnostic device 10 has a golf mat 12, which is similar to the type used at a driving range, with the top surface covered with artificial turf 14 and the bottom backing 16 fabricated from a high-traction type rubber to help prevent the mat from sliding on the underlying surface. The mat is typically 4-feet square and 1 to 2-inches thick and can be provided in configurations for both right-handed and left-handed golfers. The mat also includes a hole for inserting a golftee 18. However, unique to this golf mat is an embedded pressure sensor 30 (transducer), which is sandwiched between the top artificial grass 14 and the bottom rubber backing 16 for use in setting off an alarm 26 when the golf club strikes the area above the pressure sensor 30.

When pressure is applied to the pressure sensor 30, such as caused by a club head striking the mat above the sensor, an electrical signal is sent to the input of a timer circuit 34 located in an electronics control box 24, which then provides a signal of a few seconds in time to the input of the visible alarm 26. Power to the electronics box 24 is provided by means of a 110-volt power cord 36 or optionally the device can be operated from batteries (not shown). A side boundary line 22 and a front boundary line 28 are included on the top surface of the mat 12 to mark off the boundaries directly above the pressure sensor so a golfer will not step in this area and set off a false alarm. A hole, located just beyond the front boundary line 28 that is perpendicular to the direction of the golf swing, is include in the mat for inserting a golf tee 18. The golfer stands outside the side boundary line 22, which is parallel to the golf swing. Optionally, a golfer may remove the tee 18 and position the ball 20 on the grass surface just outside the front boundary line 28 in the general area of the tee hole.

The goal for the practice golfer is to swing through hitting the ball solidly without hitting the ground (mat) first, since any contact with the ground prior to hitting the ball will absorb some of the available dynamic energy, thereby shortening the length of the drive. FIG. 2 further illustrates the golf swing diagnostic device of the present invention for the case when a bad golf swing occurs. Here a golf ball 20 is positioned on the tee 18 and the golfer swings the club 32 with the intent of cleanly and solidly hitting nothing but the ball 20. However, as shown, the club head hits the mat just behind the ball and directly above the pressure transducer 30, thereby flashing an alarm to indicate a bad swing.

Figure 3:
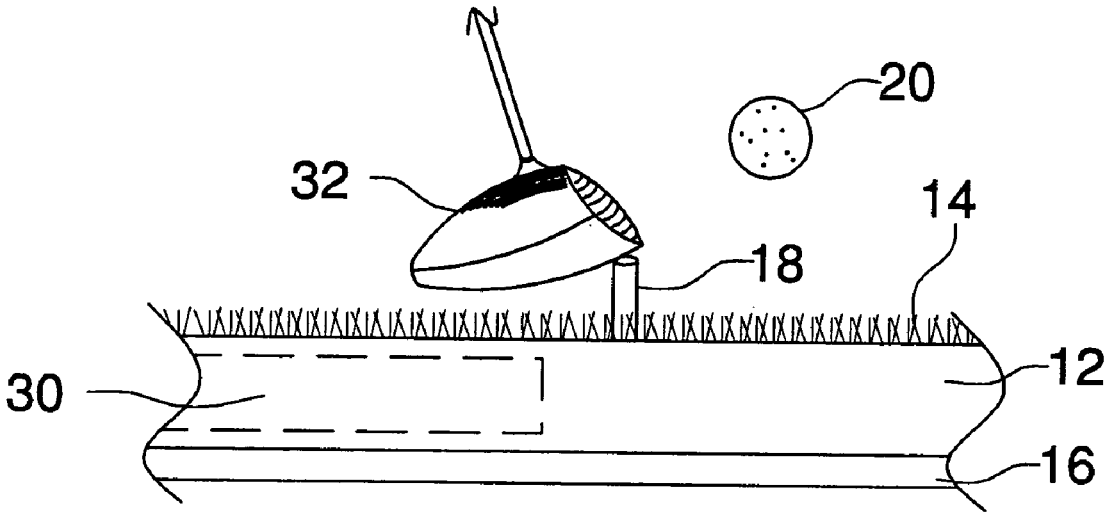
FIG. 3 is a side view of the golf swing diagnostic device of the present invention illustrating a good golf swing where the club hits the ball solidly and the dynamic energy is transferred to the ball.

On the other hand, FIG. 3 illustrates a good golf swing, in respect to not hitting the mat 12 prior to hitting the ball 20, where the club 32 makes solid contact with the ball 20.

Figure 4:
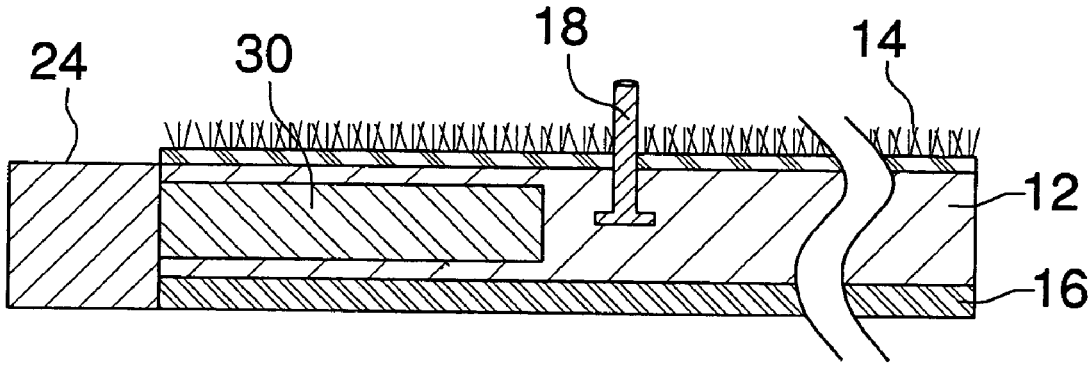
FIG. 4 is a cross-sectional side view of the golf swing diagnostic device of the present invention.

FIG. 4 is a cross-sectional side view of the golf swing diagnostic device of the present invention. This gives a better understanding of how the pressure transducer (sensor) 30 is embedded within the mat 12, as well as showing the tee 18 inserted in the mat hole. It also shows the relative positioning of the tee 18 to the front boundary just to the front of the pressure transducer 30.

Figure 5:
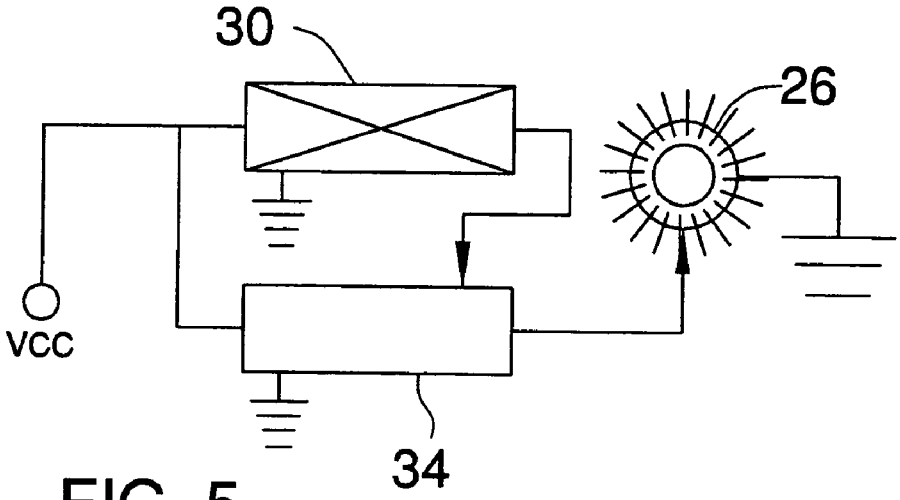
FIG. 5 is a block diagram for the visible alarm of the present invention, used to identify the case when the gold club head strikes the mat prior to contacting the ball.

Finally, FIG. 5 is a block diagram for the visible alarm of the present invention, used to identify the case when the gold club strikes the mat prior to contacting the ball. The output of the transducer 30 is coupled to the input of the electronic timer 34, which can be a mono-stable multivibrator (one-shot) or other timer circuit, with the output of the timer connected to a visible flashing light or alarm 26. In operation, when pressure is applied to the transducer 30, a short electrical pulse is coupled to the input of the timer 34. The purpose of the timer 34 is to provide a stretched pulse of a few seconds (controllable length pulse) to the alarm 26 so that the alarm will flash a light for ten seconds, just long enough to indicate to the golfer what kind of swing he/she made, but not so long as to irritate him/her.

In use, objective is to hit practice balls without making the light flash for ten seconds.

While a preferred embodiment of the golf swing diagnostic device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable artificial turf can be used for the top surface of the mat and likewise various types of backing that will grip the underlying surface and prevent movement of the mat can be used. Also, any visible alarm that provides a flashing light of liking can be installed.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A golf swing analyzing device, comprising:

a tee mat, said mat having an embedded pressure sensing means located in one corner of said mat, said embedded sensing means occupying no more than one-fourth of the topographical area of said mat, said mat further having first and second boundary lines marking the area below where said embedded sensing means is located, said first boundary line indicating the side of said embedded sensing means where a golfer stands, and said second boundary line indicating the front end of said embedded sensing means;

traction backing attached to the bottom side of said mat, thereby preventing said mat from slipping on the underlying surface;

an artificial turf surface attached to the top side of said tee mat;

a golf tee removably mounted to said mat by attaching means, said tee located just to the outside of said second front boundary line, said tee extending above said artificial turf surface;

a golf ball placed on said golf tee; and an electronic control box coupled to the output of said pressure sensing means, said electronic control box obtaining power by means of a power cord attached to a 110-volt outlet, said control box further comprising a timer circuit coupled to an audible alarm means for audibly signaling when a golf club head strikes the mat surface behind the ball prior to contacting the ball, thereby indicating a poor golf swing.

2. The device of claim 1, wherein said golf tee is removed and said golf ball is placed on said mat surface in the general area of said golf tee location.

3. The device of claim 1, wherein said embedded sensing means sends an electrical signal to said timer circuit when said golf club head strikes said mat in the area directly above said embedded sensing means, thereby triggering said timer circuit.

4. The device of claim 3, wherein when triggered said timer circuit provides an adjustable length pulsed signal to said alarm means, thereby providing an audible alarm a few seconds in time, or absence thereof, to the golfer indicating the status of the swing.

5. The device of claim 1, wherein the golfer stands on said golf mat to the side of said first boundary line, thereby avoiding falsely setting off said alarm by stepping on said pressure sensing means.

6. The device of claim 1, wherein said timer circuit and said audible alarm means are powered by batteries, said batteries being located in said control box.

7. The device of claim 4, wherein said device is configured for a right-handed golfer.

8. The device of claim 4, wherein said device is configured for a left-handed golfer.

9. A golf swing analyzing device, comprising:

a tee mat, said mat having an embedded pressure transducer located in one corner of said mat, said embedded pressure transducer occupying no more than one-fourth of the topographical area of said mat, said mat further having first and second boundary lines marking the area below where said embedded pressure transducer is located, said first boundary line indicating the side of said embedded pressure transducer where a golfer stands, and said second boundary line indicating the front end of said embedded pressure transducer;

traction backing attached to the bottom side of said mat, thereby preventing said mat from sliding on the underlying surface;

an artificial turf type surface attached to the top side of said tee mat;

a golf tee removably mounted in a hole in said golf mat, said hole located just to the outside of said second front boundary line, said tee extending above said artificial turf surface;

a golf ball placed on said golf tee; and an electronic control box coupled to the output of said pressure transducer, said electronic control box obtaining power by means of a power cord attached to a 110-volt outlet, said control box further comprising a timer circuit coupled to an audible buzzer for audibly signaling when a golf club head strikes the mat surface behind the ball prior to contacting the ball, thereby indicating a poor golf swing.

10. The device of claim 9, wherein said golf tee is removed from said hole and said golf ball is placed on said mat surface in the general location of said hole.

11. The device of claim 9, wherein said embedded pressure transducer sends an electrical signal to said timer circuit when said golf club head strikes said mat in the area directly above said embedded pressure transducer, thereby triggering said timer circuit.

12. The device of claim 11, wherein when triggered said timer circuit provides an adjustable length pulsed signal to said buzzer, thereby providing an audible alarm a few seconds in time, or absence thereof, to the golfer indicating the status of the swing.

13. The device of claim 9, wherein the golfer stands on said golf mat to the side of said first boundary line, thereby avoiding falsely setting off said alarm by stepping on said pressure transducer.

14. The device of claim 9, wherein said timer circuit and said audible buzzer are powered by batteries, said batteries being located in said control box.

15. The device of claim 9, wherein said device is configured for a right-handed golfer.

16. The device of claim 9, wherein said device is configured for a left-handed golfer.

17. A method for analyzing a golf swing, comprising:

providing a golf mat with a removable golf tee mounted in provided golf tee hole, a rubber traction layer attached to the bottom of said golf mat, an artificial turf top surface attached to the top of said golf mat, said golf mat further having an embedded pressure sensing device for detecting when a golf club strikes said golf mat in the area directly above said embedded pressure sensing device, first and second boundary lines marking the area below where said embedded pressure sensing device is located, said first boundary line indicating the side of said embedded sensing device where the golfer stands, and said second boundary line indicating the front end of said embedded pressure sensing device, a golf tee extending upward from said golf mat just in front of said second boundary line outside of said embedded sensing device area, the output signal of said embedded pressure sensing device coupled to the trigger input of a timer circuit, said timer circuit providing an adjustable length pulsed signal coupling to the input of an audible alarm for indicating when pressure is applied to said embedded pressure sensing device, said timer circuit and said audible alarm being powered by 110 volt AC power source;

placing a golf ball on top of said golf tee;

standing to outside of said first boundary line facing said golf ball on said golf tee, being certain to step beyond said boundary lines, thereby preventing setting off false alarms;

swinging said golf club in an attempt to solidly strike said golf ball without hitting said golf mat in area directly over said embedded pressure sensing device just prior to said tee;

listening for an audible alarm;

determining that if no alarm was sounded, then the club head did not strike said golf mat prior to hitting said golf ball, thereby indicating that a greater amount of the dynamic energy from the club head was transferred to said golf ball and a good swing had occurred; and further determining that if an alarm was sounded, said club head did strike said golf mat prior to hitting said golf ball, therefore indicating that a portion of said dynamic energy from said golf club was absorbed by said golf mat and a defective swing had occurred.

18. The method of claim 17, wherein said golf tee is removed from said hole and said golf ball is placed on said golf mat surface in the general location of said hole.

19. The method of claim 17, wherein said timer circuit and said audible alarm are powered by batteries.

20. The method of claim 17, wherein said device can be configured for use by:

a right-handed golfer; and a left-handed golfer.

* * * * *